US011780241B2

(12) United States Patent
Suzuki

(10) Patent No.: US 11,780,241 B2
(45) Date of Patent: Oct. 10, 2023

(54) LIQUID DISCHARGING APPARATUS, PROVIDED WITH ULTRAVIOLET IRRADIATOR, LIQUID DISCHARGING METHOD USING LIQUID DISCHARGING APPARATUS PROVIDED WITH ULTRAVIOLET IRRADIATOR AND STORAGE MEDIUM STORING PROGRAM FOR LIQUID DISCHARGING APPARATUS PROVIDED WITH ULTRAVIOLET IRRADIATOR

(71) Applicant: Brother Kogyo Kabushiki Kaisha, Nagoya (JP)

(72) Inventor: Shuhei Suzuki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/381,920

(22) Filed: Jul. 21, 2021

(65) Prior Publication Data

US 2022/0024228 A1 Jan. 27, 2022

(30) Foreign Application Priority Data

Jul. 22, 2020 (JP) ..... 2020-125362

(51) Int. Cl.

| | |
|---|---|
| ***B41J 11/00*** | (2006.01) |
| ***B41J 2/145*** | (2006.01) |
| ***B41J 2/21*** | (2006.01) |

(52) U.S. Cl.
CPC ..... *B41J 11/00214* (2021.01); *B41J 2/145* (2013.01); *B41J 2/2114* (2013.01); *B41J 11/00218* (2021.01)

(58) Field of Classification Search
CPC .... B41J 11/00214; B41J 2/145; B41J 2/2114; B41J 11/00218; B41J 19/14
See application file for complete search history.

(56) References Cited

U.S. PATENT DOCUMENTS

| | | | | |
|---|---|---|---|---|
| 10,780,718 | B2 | 9/2020 | Yamasawa et al. | |
| 2016/0297210 | A1* | 10/2016 | Klemann | B41J 2/2114 |
| 2019/0299659 | A1 | 10/2019 | Yamasawa et al. | |
| 2020/0369046 | A1 | 11/2020 | Yamasawa et al. | |

FOREIGN PATENT DOCUMENTS

| | | |
|---|---|---|
| JP | 2013-022772 A | 2/2013 |
| JP | 2019-177601 A | 10/2019 |

* cited by examiner

*Primary Examiner* — Bradley W Thies
(74) *Attorney, Agent, or Firm* — Banner & Witcoff, Ltd.

(57) ABSTRACT

A liquid discharging apparatus includes: a conveyor configured to convey a recording medium in a first direction; a discharging head configured to discharge an ultraviolet light-curable clear ink to the recording medium; an ultraviolet irradiator configured to irradiate, with ultraviolet light, the clear ink discharged to the recording medium, and arranged at a position different from the discharging head in the first direction; and a carriage configured to move in a second direction crossing the first direction, and having the discharging head and the ultraviolet irradiator mounted thereon.

16 Claims, 9 Drawing Sheets

LIQUID DISCHARGING APPARATUS, PROVIDED WITH ULTRAVIOLET IRRADIATOR, LIQUID DISCHARGING METHOD USING LIQUID DISCHARGING APPARATUS PROVIDED WITH ULTRAVIOLET IRRADIATOR AND STORAGE MEDIUM STORING PROGRAM FOR LIQUID DISCHARGING APPARATUS PROVIDED WITH ULTRAVIOLET IRRADIATOR

CROSS REFERENCE TO RELATED APPLICATIONS

The present application claims priority from Japanese Patent Application No. 2020-125362, filed on Jul. 22, 2020, the disclosure of which is incorporated herein by reference in its entirety.

BACKGROUND

The present disclosure relates to a liquid discharging apparatus, a liquid discharging method and a storage medium which are usable for an image recording apparatus such as, for example, an ink-jet printer, etc.

There is a printing technique, which has been known in the recent years, for discharging or ejecting an ultraviolet light-curable ink to a recording medium. By irradiating ink droplets landed on the recording medium with an ultraviolet light, the ink is cured to thereby fix the ink to the recording medium. In such a manner, by using the ultraviolet light-curable ink, it is possible, for example, to perform printing on a resin, metal, etc., which are different from paper sheet (paper), and to obtain a printed matter having a glossy feeling.

In a liquid discharging apparatus used in the printing technique described above, a clear ink is discharged as additional liquid droplets having a color which does not affect an image. It is known to use such a clear ink to thereby making it possible to impart a glossy feeling to a printed surface.

SUMMARY

However, even in a case that the clear ink is discharged uniformly on the printed surface, any unevenness is generated in a surface condition depending on the way of curing the clear ink. Accordingly, there is such a problem that the glossy feeling also varies or fluctuates due to the unevenness in the surface condition.

In view of the above-described situation, an object of the present disclosure is to provide a liquid discharging apparatus, a liquid discharging method and a storage medium storing a liquid discharging program each of which is capable of suppressing any variation or fluctuation of the glossy feeling reproduced by the clear ink.

According to a first aspect of the present disclosure, there is provided a liquid discharging apparatus including:

a conveyor configured to convey a recording medium in a first direction;

a discharging head configured to discharge an ultraviolet light-curable clear ink to the recording medium;

an ultraviolet irradiator configured to irradiate, with ultraviolet light, the clear ink discharged to the recording medium, and arranged at a position different from the discharging head in the first direction; and a carriage configured to move in a second direction crossing the first direction, and having the discharging head and the ultraviolet irradiator mounted thereon.

According to a second aspect of the present disclosure, there is provided a liquid discharging method of using a liquid discharging apparatus including: a conveyor configured to convey a recording medium in a first direction; a discharging head configured to discharge an ultraviolet light-curable clear ink to the recording medium; an ultraviolet irradiator configured to irradiate, with ultraviolet light, the clear ink discharged to the recording medium, and arranged at a position different from the discharging head in the first direction; and a carriage configured to move in a second direction crossing the first direction, and having the discharging head and the ultraviolet irradiator mounted thereon, the liquid discharging method including:

discharging the clear ink from the discharging head to a predetermined print area on the recording medium while moving the carriage in the second direction;

after the discharge of the clear ink, conveying the recording medium in the first direction to move the predetermined print area on the recording medium into an irradiation range of the ultraviolet light by the ultraviolet irradiator; and after the conveyance of the recording medium, irradiating the clear ink, which is discharged to the predetermined print area on the recording medium, with the ultraviolet light from the ultraviolet irradiator, while moving the carriage in the second direction.

According to a third aspect of the present disclosure, there is provided a non-transitory computer-readable storage medium storing a computer-executable liquid discharging program for a liquid discharging apparatus including: a conveyor configured to convey a recording medium in a first direction; a discharging head configured to discharge an ultraviolet light-curable clear ink to the recording medium; an ultraviolet irradiator configured to irradiate, with a ultraviolet light, the clear ink discharged to the recording medium, and arranged at a position different from the discharging head in the first direction; a carriage configured to move in a second direction crossing the first direction, and having the discharging head and the ultraviolet irradiator mounted thereon; and a controller configured to control the conveyor, the discharge head, the ultraviolet irradiator, and the carriage, the liquid discharging program causing the controller to:

discharge the clear ink to a predetermined print area on the recording medium while moving the carriage in the second direction;

after the discharge of the clear ink, convey the recording medium in the first direction to move the predetermined print area on the recording medium into an irradiation range of the ultraviolet light by the ultraviolet irradiator; and after the conveyance of the recording medium, irradiate the clear ink, which is discharged to the predetermined print area on the recording medium, with the ultraviolet light from the ultraviolet irradiator, while moving the carriage in the second direction.

DETAILED DESCRIPTION

In the following, a liquid discharging apparatus according to an embodiment of the present disclosure and an image recording apparatus provided with the same will be explained, with reference to the drawings. The liquid discharging apparatus and the image recording apparatus to be explained below are merely an embodiment of the present disclosure. Therefore, the present disclosure is not limited to or restricted by the following embodiment, and any addition, deletion and change are possible in a range not deviating from the gist of the present disclosure.

Figure 1:
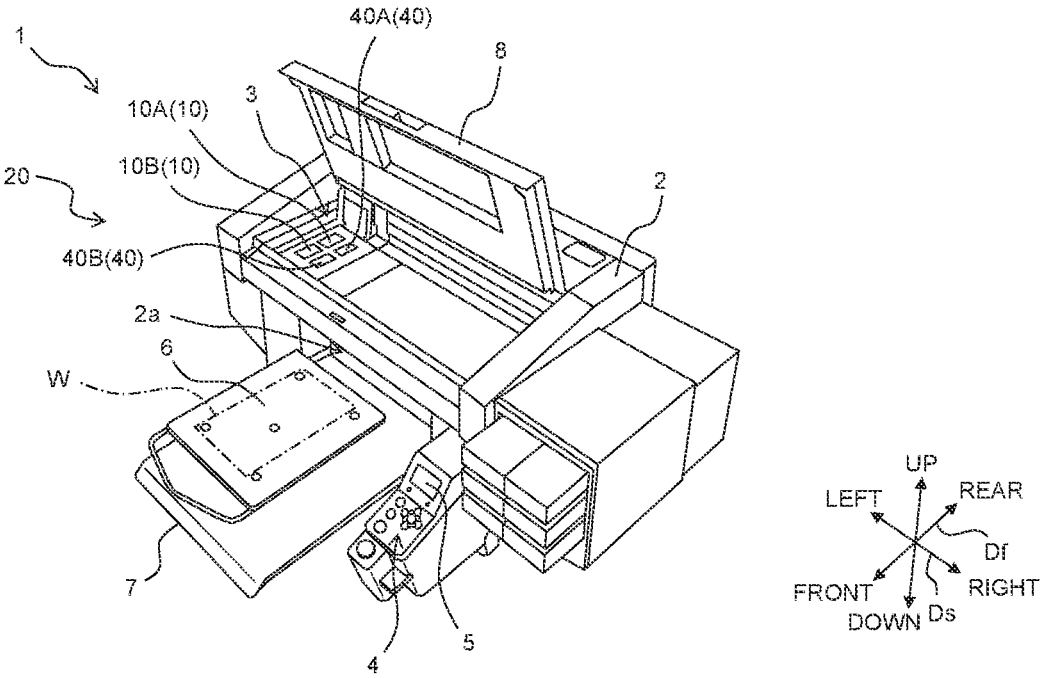
FIG. 1 is a perspective view depicting an image recording apparatus provided with a liquid discharging apparatus.

FIG. 1 is a perspective view depicting an image recording apparatus 1 provided with a liquid discharging apparatus 20 according to an embodiment of the present disclosure. In FIG. 1, mutually orthogonal directions are referred to as "up-down direction (third direction)", "left-right direction (second direction)" and "front-rear direction (first direction) ". Note that the left-right direction is a main scanning direction Ds and the front-rear direction is a sub scanning direction (corresponding to a conveying direction) Df which is a direction orthogonal to the main scanning direction Ds. The image recording apparatus 1 is capable of performing printing not only on a recording medium (printed matter) W such as a print paper sheet (print paper), but also on a recording medium W which is an impermeable medium such as a resin, a metal, etc.

As depicted in FIG. 1, the image recording apparatus 1 of the present embodiment is provided with: a casing 2, an operating key 4, a displaying part 5, a tray 7, an upper cover 8 and a liquid discharging apparatus 20. In the present embodiment, the liquid discharging apparatus 20 has a carriage 3, a stage 6, two discharging heads 10 (10A, 10B), two ultraviolet irradiators (ultraviolet light irradiating devices) 40 (40A, 40B) and a control device 71 (controller) (see FIG. 3). The discharging head 10A is an ink-jet head which discharges or ejects at least an ultraviolet light-curable clear ink. Specifically, the discharging head 10A discharges the clear ink, and discharges also ultraviolet light-curable inks of respective colors which are yellow (Y), magenta (M), cyan (C) and black (K) which are collectively referred to as a color ink, in some cases. Such a discharging head 10A has a plurality of nozzle rows (nozzle arrays) provided thereon and corresponding to the respective inks, and each of the nozzle rows includes a plurality of nozzles which are arranged side by side at a constant spacing distance therebetween along the sub scanning direction Df. The ultraviolet light-curable ink is discharged from the plurality of nozzles. Note that it is allowable to use, as the discharging head 10B, an ink-jet head which discharges, for example, a color ink of a ultraviolet light-curable type. Note that the term "color ink" means an ink containing a colorant. On the other hand, the term "clear ink" means an colorless and transparent ink or an ink having a light color to such an extent that does not affect the color of the image. It is allowable that the clear ink does not contain any colorant, or contains a colorant in an amount to such an extent that does not affect the color of the image.

Each of the ultraviolet irradiators 40 has a plurality of light emitting diode chips (not depicted in the drawings) which emit an ultraviolet light, and performs irradiation of the ultraviolet light for curing the ink discharged by the discharging head(s) 10 on the recording medium W which is conveyed in the conveying direction. In FIG. 1, the recording medium W is conveyed from the rear side toward the front side of the conveying direction (front-rear direction, first direction). Accordingly, the rear side is the upstream side of the conveying direction (one side of the first direction) and the front side is the downstream side of the conveying direction (the other side of the first direction). By irradiating the ink with the ultraviolet light from the light emitting diode chips, a photopolymerization initiator contained in the ink reacts, thereby polymerizing a monomer contained in the ink, and allowing the ink to be fixed to the recording medium W. The respective light emitting diode chips are arranged, for example, in a matrix form. Such an ultraviolet irradiator 40 irradiates the ultraviolet light so that the intensity of the ultraviolet light becomes to be weaker on the recording medium W, from the upstream side toward the downstream side in the conveying direction. In this situation, it is the ultraviolet irradiator 40B which irradiates, with the ultraviolet light, the clear ink discharged by the discharging head 10A to thereby cure the clear ink. The detail of this configuration will be explained later on.

Figure 2:
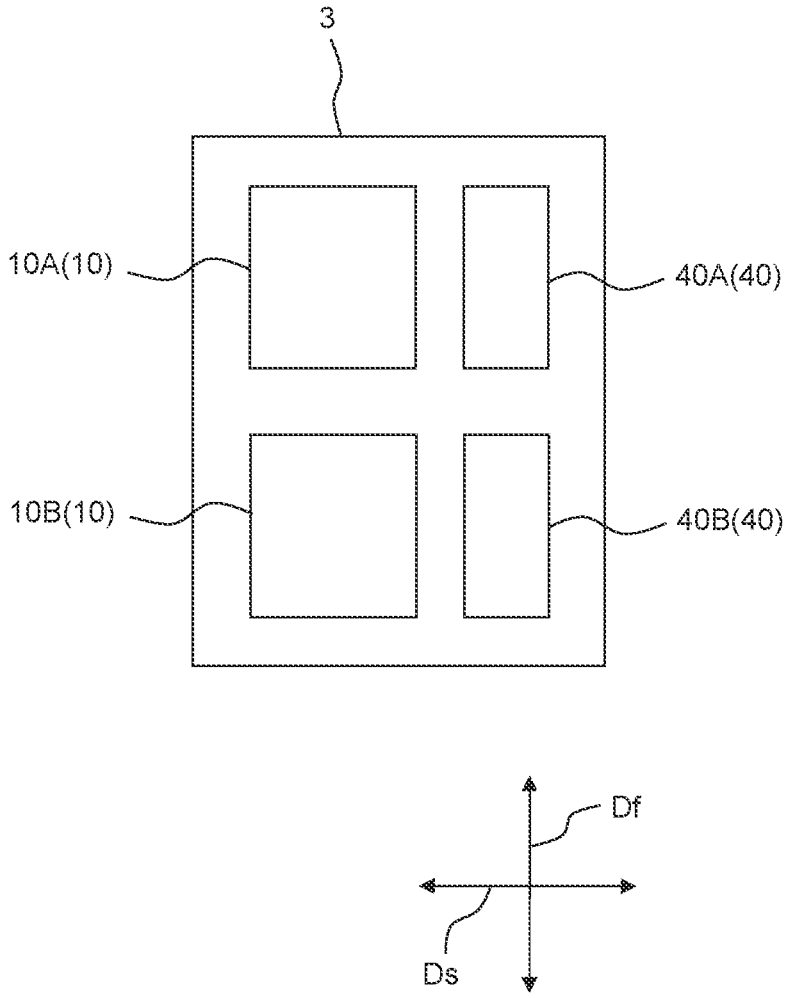
FIG. 2 is a plan view depicting an example of arrangement of a discharging head and an ultraviolet irradiator which are mounted on a carriage of FIG. 1.

As depicted in FIG. 2, the discharging head 10A and the discharging head 10B are arranged side by side along the sub scanning direction Df. The discharging head 10B is arranged in front of the discharging head 10A. Further, the ultraviolet irradiator 40A and the ultraviolet irradiator 40B are arranged side by side along the sub scanning direction Df. The ultraviolet irradiator 40B is arranged in front of the ultraviolet irradiator 40A. Furthermore, the discharging head 10A and the ultraviolet irradiator 40A are arranged side by side along the main scanning direction Ds. The ultraviolet irradiator 40A is arranged on the right side of the discharging head 10A. Further, the discharging head 10B and the ultraviolet irradiator 40B are arranged side by side along the main scanning direction Ds. The ultraviolet irradiator 40B is arranged on the right side of the discharging head 10B. In such a configuration, the ultraviolet irradiator 40B is arranged at a position different from discharging head 10A in the conveying direction. Namely, the ultraviolet irradiator 40B is arranged to be apart in the conveying direction with respect to the discharging head 10A. In the conveying direction, a range occupied by the ultraviolet irradiator 40B and a range occupied by the discharging head 10A do not overlap with each other. Further, in the scanning direction Ds, a range occupied by the ultraviolet irradiator 40B and a range occupied by the discharging head 10A do not overlap with each other.

The casing 2 is formed, for example, to have a boxed shape. The casing 2 has an opening 2*a* in the front surface thereof, and a non-illustrated opening on the rear surface thereof. The operating key 4 is provided on the casing 2, at a right front position. Further, a displaying part 5 is provided on the casing 2 at a location behind the operating key 4. The operating key 4 receives an operating input by a user. The displaying part 5 is constructed, for example, of a touch panel, and displays predetermined information. A part of the displaying part 5 functions also as an operating key, at a predetermined timing. The control device 71 realizes a printing function based on an input form the operating key 4 or based on an external input via a network interface 70 (to be described later on), and controls the display of the displaying part 5.

The carriage 3 is configured to be movable in a reciprocating manner along the main scanning direction Ds. The above-described discharging heads 10 and the ultraviolet irradiators 40 are each supported by and mounted on the carriage 3. With this, the discharging heads 10 and the ultraviolet irradiators 40 are also made to be movable in a reciprocating manner along the main scanning direction Ds.

The stage 6 is configured so that the recording medium W is placeable thereon. The stage 6 has a predetermined thickness, and is constructed, for example, of a rectangular-shaped plate member of which longitudinal direction is the sub scanning direction Df. The stage 6 is configured to be attachable and detachable by a non-illustrated stage supporting stand. The stage supporting stand is configured to be movable between a printing position at which printing with respect to the recording medium W is executed and an attaching/detaching position at which the recording medium W is detached or removed from the stage 6. The printing position is a position at which the stage 6 faces or is opposite to the discharging heads 10, and the attaching/detaching position is a position at which the above-described stage supporting stand is arranged at the outside of the casing 2 and at which the recording medium W is placeable on the stage 6. At a time of the printing, since the stage 6 is moved in the sub scanning direction Df (namely, in the conveying direction), the recording medium W placed on the stage 6 also is conveyed in the conveying direction.

The tray 7 is provided at a location below the stage 6. The tray 7 has a predetermined thickness, and is constructed, for example, of a rectangular plate-shaped member of which longitudinal direction is the sub scanning direction Df. Further, the upper cover 8 is configured such that in a case that a front part thereof is lifted, the upper cover 8 is rotated (pivoted) upward, with a base end thereof configured to be rotatable (pivotable) as the fulcrum. With this, the internal part of the casing 2 is exposed.

Figure 3:
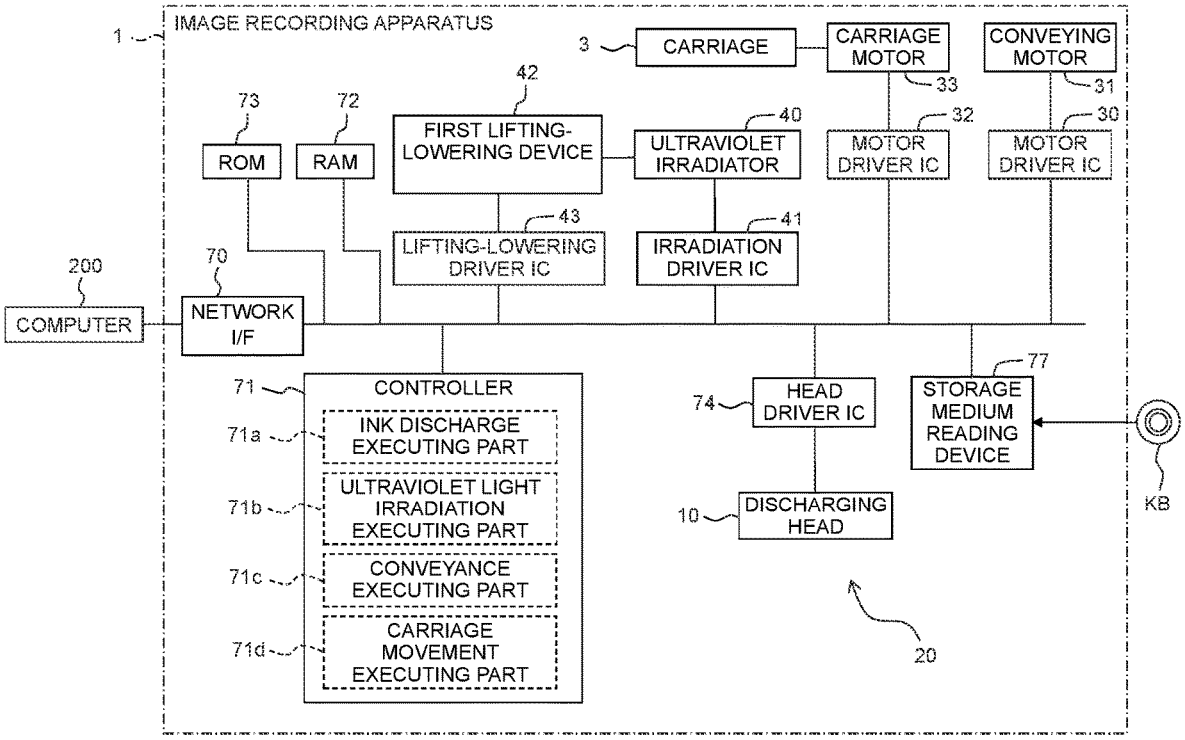
FIG. 3 is a block diagram depicting the construction of the image recording apparatus of FIG. 1.

Next, the other configuration of the image recording apparatus 1 provided with the liquid discharging apparatus 20 of the present embodiment will be explained, with reference to a block diagram of FIG. 3.

In addition to the constitutive elements as described above, the image recording apparatus 1 of the present embodiment is provided with: a network interface (I/F) 70; a control device (controller) 71 constructed of a CPU, etc.; a RAM 72; a ROM 73; a head driver IC 74; a storage medium reading device 77; motor driver ICs 30, 32; a conveying motor 31; a carriage motor 33; an irradiation driver IC 41; a first lifting-lowering device 42; and a lifting-lowering driver IC 43. The conveying motor 31 operates the stage 6 corresponding to the conveyor to thereby convey the recording medium W in the conveying direction (namely, the sub scanning direction Df) which is a direction orthogonal to a moving direction of the carriage 3 (namely, the main scanning direction Ds). Note that the control device 71 corresponds to a "computer".

The control device 71 has, as functional configuration thereof, an ink discharge executing part 71*a*, an ultraviolet light irradiation executing part 71*b*, a conveyance executing part 71*c* and a carriage movement executing part 71*d*. The control device 71 executes a predetermined liquid discharging program to thereby functionally realize the above-described ink discharge executing part 71*a*, ultraviolet light irradiation executing part 71*b*, conveyance executing part 71*c* and carriage movement executing part 71*d*. Note that the ink discharge executing part 71*a* corresponds to an "ink discharge executing mechanism", the ultraviolet light irradiation executing part 71*b* corresponds to an "ultraviolet light irradiation executing mechanism" and the conveyance executing part 71*d* corresponds to a "conveyance executing mechanism".

The ink discharge executing part 71*a* executes a discharging processing of causing the discharging head 10A to discharge the above-described clear ink. Specifically, the ink discharge executing part 71*a* causes the head driver IC 74 to control the operation of the discharging head 10, based on raster data for discharging a liquid droplet of an ink (ink liquid droplet) corresponding to an image to be formed on the recording medium W. With this, the clear ink is discharged by the discharging head 10A.

Further, the ultraviolet light irradiation executing part 71*b* executes an irradiating processing of causing the ultraviolet irradiator 40B to irradiate the clear ink, which is discharged by the discharging head 10A, with the ultraviolet light. Namely, it is configured that the ultraviolet irradiator 40B which is arranged on the downstream side in the conveying direction with respect to the discharging head 10A irradiates the clear ink discharged by the discharging head 10A with the ultraviolet light so as to cure the clear ink. Note that the flow of this processing will be described in detail later on, with reference to the drawings.

Furthermore, the conveyance executing part 71*c* executes a conveying processing of driving the conveying motor 31*c* to thereby cause the stage 6 to convey the recording medium W. It is configured that the conveying motor 31 is driven to thereby convey the recording medium W from the upstream side toward the downstream side in the conveying direction.

Moreover, the carriage movement executing part 71*d* executes a moving processing of moving the carriage 3 in the main scanning direction Ds. In a case that the discharging processing and the irradiating processing as described above are performed, the carriage 3 is moved in the main scanning direction Ds. With this, it is configured that the discharging heads 10 and the ultraviolet irradiators 40 mounted on the carriage 3 are moved in the main scanning direction Ds in a case that the discharging processing and the irradiating processing are performed. Note that in the following, a processing including the discharging processing, the irradiating processing, the conveying processing and the moving processing is collectively referred to as a surface uniformizing printing.

The RAM 72 temporarily stores a print job received from a computer 200 such as an external personal computer, etc., via the network interface 70. Further, the RAM 72 temporarily stores print data of each pass.

The RAM 73 stores the liquid discharging program of the present embodiment and a control program for performing a variety of kinds of data processing.

The head driver IC 74 receives an instruction or command from the control device 71 so as to cause the discharging head 10 to discharge the ink. Similarly, the motor driver IC 30 receives an instruction from the control device 71 so as to perform driving control of the conveying motor 31, and motor driver IC 32 receives an instruction from the control device 71 so as to perform driving control of the carriage motor 33. Further, the irradiation driver IC 41 receives an instruction from the control device 71 so as to cause the ultraviolet irradiator 40 to perform irradiation of the ultraviolet light. Furthermore, the lifting-lowering driver IC 43 receives an instruction from the control device 71 so as to cause the first lifting-lowering device 42 to lift or lower the ultraviolet irradiator 40.

The storage medium reading device 77 is a device which reads the liquid discharging program from, for example, a storage medium KB which is a computer-readable medium such as a flexible disk, a CD (CD-ROM, CD-R, CD-RW, etc.), DVD (DVD-ROM, DVD-RAM, DVD-R, DVD+R, DVD-RW, DVD+RW, etc.), a Blu-ray disc, a magnetic disc, an optical disc and a magneto-optical disc, etc. The storage medium reading device 77 may be, for example, a device which reads the liquid discharging program from a storage medium such as a USB flash memory, etc. The read liquid discharging program is stored in the ROM 73, and is executed by the control device 71. Note that the liquid discharging program of the present embodiment may be stored in the ROM 73 from the external computer 200 via the network interface 70, or may be downloaded from the Internet and be stored in the ROM 73.

The first lifting-lowering device 42 lifts and lowers the ultraviolet irradiator 40 (ultraviolet irradiator 40B) with respect to the recording medium W. Namely, the first lifting-lowering device 42 moves the ultraviolet irradiator 40 (ultraviolet irradiator 40B) in the up-down direction. In the liquid discharging apparatus 20, the control device 71 controls the discharging heads 10 (10A, 10B) and the ultraviolet irradiators 40 (40A, 40B) so as to discharge the color ink from the discharging head(s) 10, and irradiate the color ink discharged onto the recording medium W with the ultraviolet light from the ultraviolet irradiator(s) 40. Further, the control device 71 lifts, by the first lifting-lowering device 42, the ultraviolet irradiator 40B so that a distance L1 (see FIG. 5) between the recording medium W and an irradiating surface of the ultraviolet irradiator 40B is made to be greater in a case that the ultraviolet irradiator 40B cures the clear ink than that in a case that the ultraviolet irradiator 40B cures the color ink. With this, the spacing distance between the recording medium W and the irradiating surface of the ultraviolet irradiator 40B can be made to be relatively large, thereby making it possible to make the intensity of the ultraviolet light with respect to the clear ink on the recording medium W to be relatively weak.

In the following, a method of suppressing any variation or fluctuation of the glossy feeling reproduced by the clear ink will be explained, with reference to the drawings.

Figure 4A:
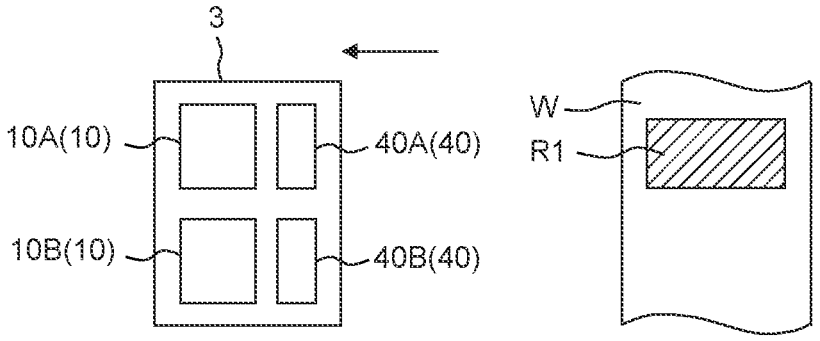
FIGS. 4A to 4C are views explaining a discharging processing and an irradiating processing.
Figure 4B:
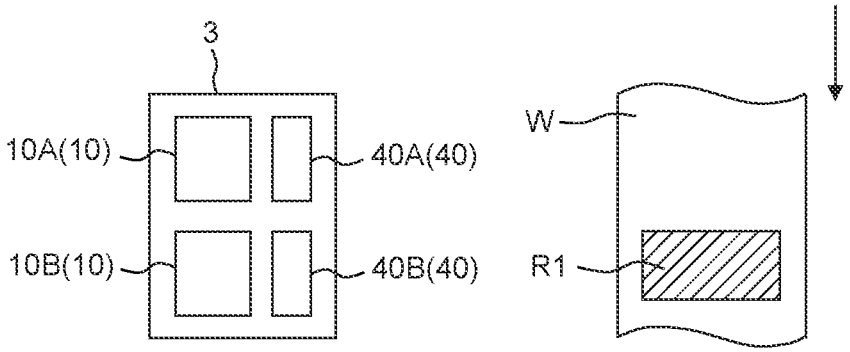
Figure 4C:
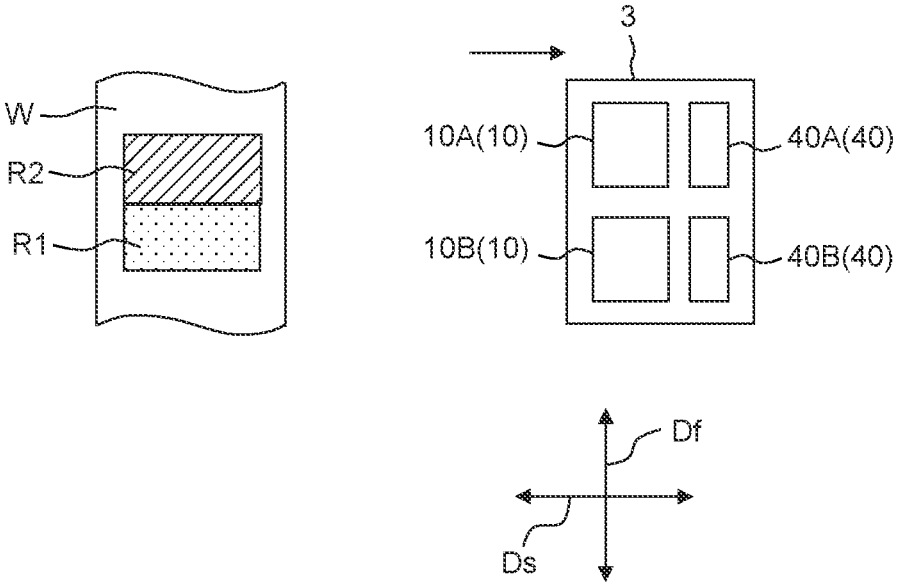

FIGS. 4A to 4C are views explaining the discharging processing and the irradiating processing. As depicted in FIG. 4A, the control device 71 firstly executes the discharging processing of causing the discharging head 10A to discharge or eject the clear ink with respect to a predetermined print area R1 on the recording medium W, while moving the carriage 3 from the right side toward the left side in the main scanning direction Ds. With this, the clear ink is discharged to the predetermined print area R1 of the recording medium W. Note that in this situation, the discharging head 10B does not perform the discharging processing, and the ultraviolet irradiator 40A does not perform the irradiating processing.

After performing the discharging processing, as depicted in FIG. 4B, the control device 71 executes the conveying processing so that the predetermined print area R1 on the recording medium W is moved into an irradiation range of the ultraviolet light by the ultraviolet irradiator 40B. With this, the recording medium W is conveyed to the downstream side in the conveying direction, and the predetermined print area R1 is moved into the irradiation range of the ultraviolet light by the ultraviolet irradiator 40B.

Further, after performing the conveying processing, as depicted in FIG. 4C, the control device 71 executes the irradiating processing of causing the ultraviolet irradiator 40B to irradiate, with the ultraviolet light, the predetermined print area R1 on the recording medium W while causing the carriage 3 to move in a direction opposite to the direction in the main scanning direction Ds in FIG. 4A as descried above, namely, from the left side toward the right side in the main scanning direction Ds. With this, it is configured that, with a predetermined time interval (time) since the time when the clear ink has been discharged from the discharging head 10A in FIG. 4A as described above (namely, a time required for the conveyance), the clear ink is irradiated with the ultraviolet light. With this, an aspect of the irradiation of ultraviolet light in the present embodiment is different from a conventional aspect in which the ink immediately after having landed on the recording medium W is irradiated with the ultraviolet light. Further, together with the above-described irradiating processing, the clear ink is discharged by the discharging head 10A with respect to an area R2 which is different from the predetermined print area R1 (an area on the upstream side in the conveying direction of the print area R1) on the recording medium W. At the time of the processing of FIG. 4C, the ultraviolet irradiator 40A does not perform the irradiating processing. In such a manner, in the present embodiment, the orientation of the movement (orientation from the right side toward the left side) in the main scanning direction Ds of the carriage 3 in the discharging processing is opposite to the orientation of the movement (orientation from the left side toward the right side) of in the main scanning direction Ds of the carriage 3 in the irradiating processing.

Next, the distance L1 in the up-down direction between the recording medium W and an irradiating surface 40*t* of the ultraviolet irradiator 40B will be explained.

Figure 5:
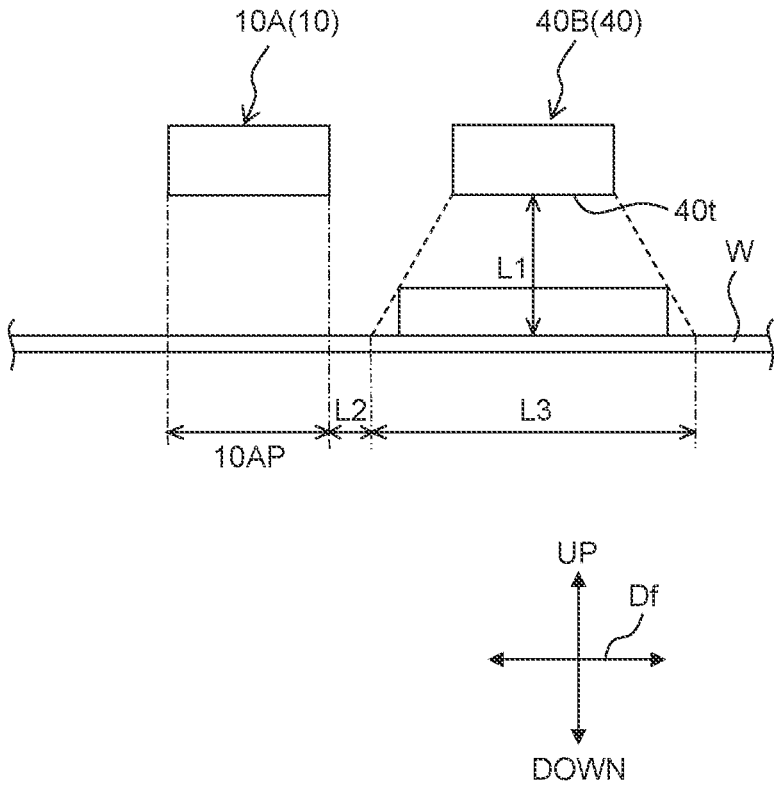
FIG. 5 is a view for explaining the distance between a recording medium and an irradiating surface of the ultraviolet irradiator.

As depicted in FIG. 5, in the present embodiment, an irradiation range L3, on the recording medium W, which is irradiated with the ultraviolet light radiated by the ultraviolet irradiator 40B does not overlap with the discharging head 10A in the sub scanning direction Df (namely, the conveying direction). The irradiation range L3, of the ultraviolet light by the ultraviolet irradiator 40B, on the recording medium W does not overlap with a projected area 10AP of the discharging head 10A on the recording medium W. The irradiation range L3, on the recording medium W, which is irradiated with the ultraviolet light is changed or varies depending on the distance L1 in the up-down direction between the recording medium W and the irradiating surface 40*t* of the ultraviolet irradiator 40B. As the distance L1 is greater, the irradiation range L3 becomes greater. The distance L1 has a magnitude to such an extent that the irradiation range L3 does not overlap with the projected area 10AP of the discharging head 10A on the recording medium W. Namely, the distance L1 has a magnitude to such an extent that a predetermined distance L2 (a distance in the sub scanning direction Df) can be present between an end part, of the irradiation range L3, on the side of the discharge head 10A and an end part, of the discharge head 10A, on the side of the ultraviolet irradiator 40B.

Next, the flow of a printing processing by the liquid discharging apparatus 20 in the image recording apparatus 1 of the present embodiment will be explained, with reference to a flow chart of FIG. 6.

Figure 6:
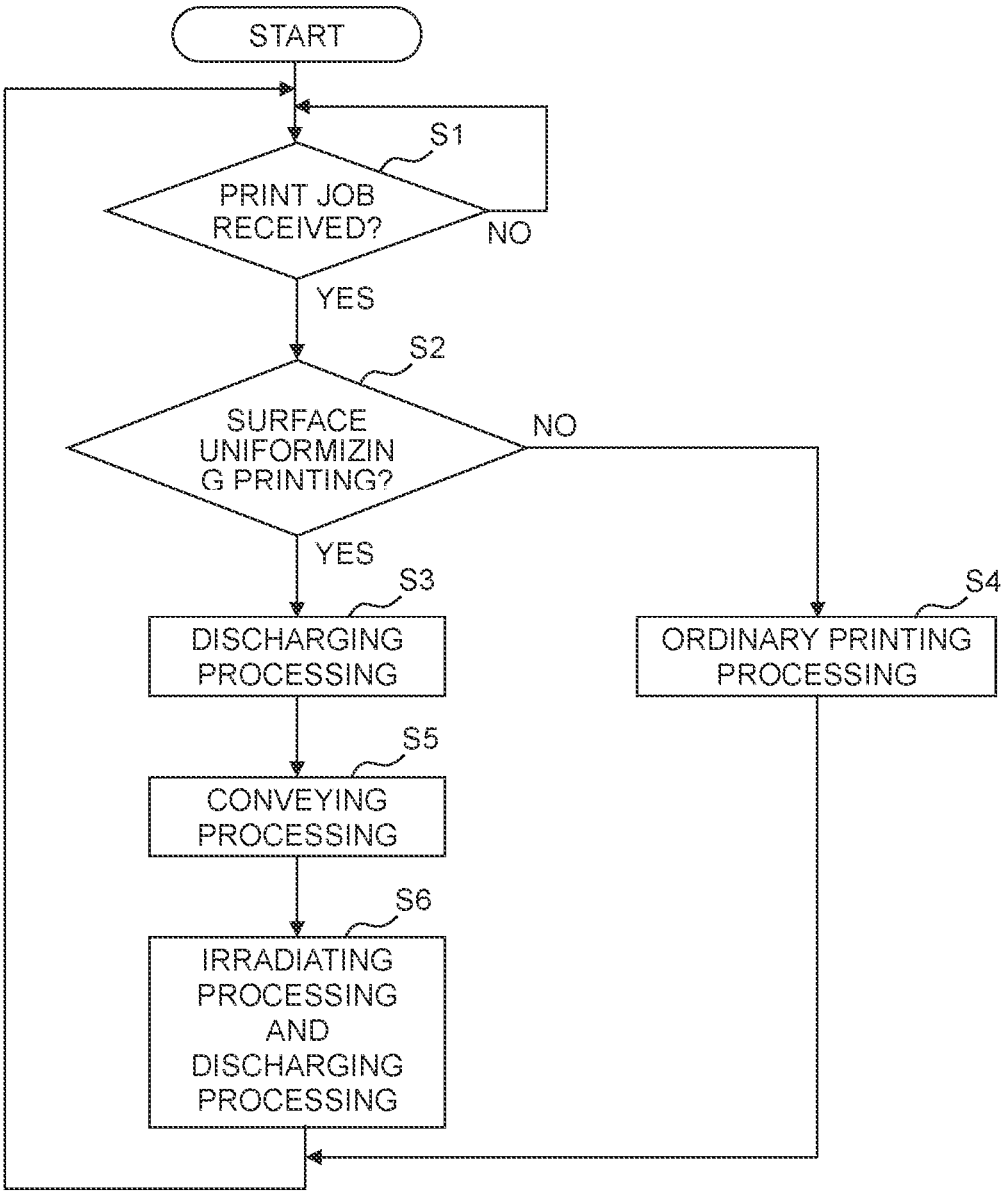
FIG. 6 is a flow chart indicating the flow of a printing processing by the liquid discharging apparatus.

As depicted in FIG. 6, the control device 71 firstly determines whether or not a print job has been received from the external computer 200 via the network interface 70 (step S1). In a case that the print job has not been received (step S1: NO), the control device 71 stands by until the print job is received.

On the other hand, in a case that the print job has been received from the external computer 200 via the network interface 70 (step S1: YES), the control device 71 determines whether or not an instruction for turning ON a flag of the surface uniformizing printing is written in the header of the print job (step S2). In a case that the flag of the surface uniformizing printing is ON (step S2: YES), the control device 71 executes the above-described discharging processing, based on the print job (step S3). On the other hand, in a case that the flag of the surface uniformizing printing is not ON (step S2: NO), the control device 71 performs an ordinary printing processing (step S4). Note that after the processing of step S4, the control device 71 returns to step S1 and waits for a next print job.

After the processing of step S3, the control device 71 executes the above-described conveying processing (step S5), and then executes the irradiating processing (irradiating processing with respect to the area R1) and the discharging processing (discharging processing with respect to the area R2) (step S6). Afterwards, the control device 71 returns to step S1 and waits for a next print job.

As described above, according to the liquid discharging apparatus 20 of the present embodiment, since the ultraviolet irradiator 40B is arranged at the position different from the discharging head 10A in the conveying direction (at the position on the downstream side in the conveying direction with respect to the discharging head 10A), it is possible to convey the recording medium W, after the completion of the discharge of the clear ink by the discharging head 10A, toward the ultraviolet irradiator 40B which is arranged at the position different from the discharging head 10A in the conveying direction. With this, it is possible to subject the discharged clear ink to the levelling during the time required for conveying the recording medium W to reach up to the irradiation range L3 of the ultraviolet light by the ultraviolet irradiator 40B. Further, it is possible to irradiate the levelled clear ink with the ultraviolet light by the ultraviolet irradiator 40B. By irradiating the clear ink in the levelled state with the ultraviolet light in such a manner, it is possible to suppress the generation of unevenness in the surface condition of the recording medium W, thereby making it possible to ensure the uniformity (evenness) of the surface condition, as compared with the conventional case. With this, it is possible to suppress any variation or fluctuation in the glossy feeling reproduced by the clear ink.

Further, in the present embodiment, after executing the discharging processing of causing the discharging head 10A to discharge the clear ink with respect to the predetermined print area R1 on the recording medium W while moving the carriage 3 from the right side to the left side in the main scanning direction Ds, the control device 71 executes the conveying processing of moving the predetermined print area R1 on the recording medium W into the irradiation range L3 of the ultraviolet light by the ultraviolet irradiator 40B, and then executes the irradiating processing of causing the ultraviolet irradiator 40B to irradiate the predetermined range R1 on the recording medium W with the ultraviolet light while moving the carriage 3 from the left side to the right side in the main scanning direction Ds. With this, after the completion of the discharging processing and at the time of executing the conveying processing, it is possible to subject the discharged clear ink to the levelling during the time required for the execution of the conveying processing.

Furthermore, in the present embodiment, the orientation of the movement in the main scanning direction Ds of the carriage 3 in the discharging processing is opposite to the orientation of the movement in the main scanning direction Ds of the carriage 3 in the irradiating processing. With this, it is possible to make the printing time to be short.

Moreover, in the present embodiment, the ultraviolet irradiator 40B is configured to irradiate the recording medium with the ultraviolet light so that the intensity of the ultraviolet light becomes to be weaker on the recording medium W, from the upstream side toward the downstream side in the conveying direction. With this, it is possible to suppress generation of any unevenness due to the curing shrinkage at the time of the curing of the clear ink. Regarding this point, in a case that the clear ink is irradiated with an ultraviolet light having a strong intensity, any concavities and convexities are likely to be generated on a surface of the cured clear ink, which in turn leads to such a situation that these concavities and convexities reflect the light diffusely, thereby generating any unevenness in the glossiness. In a case that the intensity of the ultraviolet light is gradually weakened from the upstream side toward the downstream side in the conveying direction, as in the present embodiment, it is possible to suppress the generation of the concavities and convexities on the surface of the cured clear ink. For example, the control device 71 controls the intensity of the irradiation with the ultraviolet light emitted from the respective light-emitting diode chips of the ultraviolet irradiator 40 (40B) so that the intensity of the ultraviolet light is weakened from the upstream side toward the downstream side in the conveying direction.

Further, in the present embodiment, the control device 71 moves, by the first lifting-lowering device 42, the ultraviolet irradiator 40B in the up-down direction so that the distance L1 in the up-down direction between the recording medium W and the irradiating surface 40*t* of the ultraviolet irradiator 40B is made to be greater in a case that the ultraviolet irradiator 40B irradiates the clear ink with the ultraviolet light than that in a case that the ultraviolet irradiator 40B irradiates the color ink with the ultraviolet light. With this, it is possible to make the intensity of the ultraviolet light per unit area with respect to the clear ink to be small, thereby making it possible to suppress the generation of unevenness in the glossiness.

Furthermore, in the present embodiment, the irradiation range L3, on the recording medium W, which is irradiated with the ultraviolet light radiated by the ultraviolet irradiator 40B does not overlap with the projected area 10AP of the discharging head 10A on the recording medium W. The distance L1 between the recording medium W and the irradiating surface 40*t* of the ultraviolet irradiator 40B has the magnitude to such an extent that the irradiation range L3 of the ultraviolet light does not overlap with the projected area 10AP of the discharging head 10A on the recording medium W. The control device 71 controls the first lifting-lowering device 42 so as to move the ultraviolet irradiator 41 in the up-down direction so that the irradiation range L3 of the ultraviolet light does not overlap with the projected area 10AP of the discharging head 10A on the recording medium W. With this, it is possible to prevent the clear ink discharged to the area R2 by the discharging head 10A in the case depicted in FIG. 4C from being irradiated with the ultraviolet light by the ultraviolet irradiator 40B. With this, it is possible to subject the clear ink discharged by the discharging head 10A to the area R2 to the levelling.

Further, in the present embodiment, it is allowable that the discharging processing of the clear ink, the conveying processing of the recording medium W, and the irradiating processing of the clear ink with the ultraviolet light as described above are performed in this order for a plurality of times, and that the irradiation of the clear ink with the ultraviolet light and the discharge of the clear ink which is to be executed next thereto are executed at the same time. Namely, as depicted in FIG. 4C, it is allowable that together with the irradiating processing with respect to the print area R1, the clear ink is discharged from the discharging head 10A with respect to the area R2 which is different from the predetermined print area R1 (the area on the upstream side in the conveying direction of the print area R1) on the recording medium W.

[Modifications]

The present disclosure is not limited to the above-described embodiment, and a variety of kinds of modification, within the range not departing from the gist of the present disclosure are possible, as exemplified in the following.

In the present embodiment, the orientation of the movement along the main scanning direction Ds of the carriage 3 in the discharging processing is made to be opposite to the orientation of the movement along the main scanning direction Ds of the carriage 3 in the irradiating processing (bidirectional printing). The present disclosure, however, is not limited to or restricted by this. It is allowable to make the orientation of the movement along the main scanning direction Ds of the carriage 3 in the discharging processing (for example, the direction from the right side toward the left side) is made to be same as the orientation of the movement along the main scanning direction Ds of the carriage 3 in the irradiating processing (unidirectional printing). With this, it is possible to make any risk of a lowered print quality due to any minute deviation which might occur during the bidirectional printing. Further, in such a modification, between the discharging processing and the irradiating processing, the control device 71 may move the carriage 3 to move in an opposite orientation which is opposite to the moving orientation along the scanning direction at the time of the discharging processing, and may execute the conveying processing as well. At the time of the unidirectional printing as described above, by performing the conveying processing for the recording medium W while moving the carriage 3 in the opposite orientation so as to return the carriage 3 to a predetermined position, it is possible to shorten the printing time, as compared with a case of performing the conveying processing after the completion of returning the carriage 3 to the predetermined position.

Figure 7:
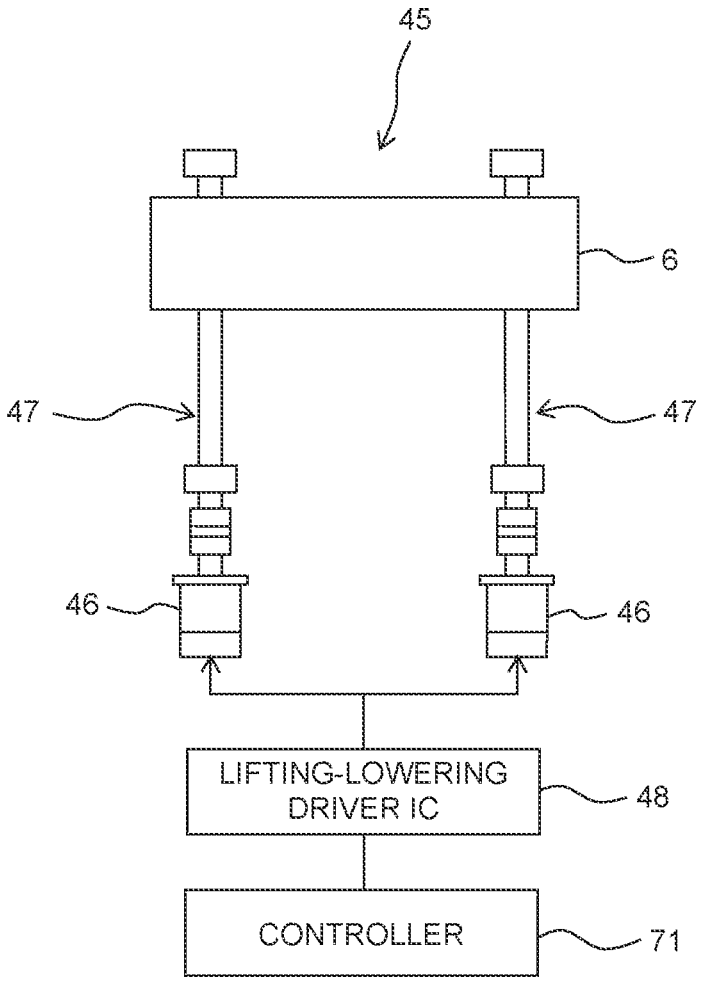
FIG. 7 is a schematic view of a second lifting-lowering device which lifts and lowers a stage with respect to the irradiating surface of the ultraviolet irradiator.

Further, in the present embodiment, the control device 71 lifts, by the first lifting-lowering device 42, the ultraviolet irradiator 40B so that the distance L1 between the recording medium W and the irradiating surface 40*t* of the ultraviolet irradiator 40B is made to be greater in a case that the ultraviolet irradiator 40B cures the clear ink than that in a case that the ultraviolet irradiator 40B cures the color ink. The present disclosure, however, is not limited to this. As depicted in FIG. 7, it is allowable that the liquid discharging apparatus 20 is provided with a second lifting-lowering device 45 which lifts and lowers the stage 6 with respect to the irradiating surface 40*f* of the ultraviolet light irradiating apparatus 40B, rather than the first lifting-lowering device 42. The stage 6 is lifted and lowered with respect to the irradiating surface 40*t* of the ultraviolet irradiator 40B by this second lifting-lowering device 45. Namely, the second lifting-lowering device 45 moves the stage 6 in the up-down direction. The second lifting-lowering device 45 is provided with a pair of lifting-lowering motors 46 and a pair of boll screws 47. Non-illustrated nuts are screwed to the respective ball screws 47 of the pair, and the nuts are connected to the stage 6. In such a configuration, the lifting-lowering driver IC 48 receives an instruction from the control device 71 so as to control and rotate the lifting-lowering motors 46, which in turn rotate the pair of ball screws 47 about the respective axes thereof, thereby converting the rotational motions of the pair of ball screws 47 into a lifting-lowering motion (transitory movement) of the nuts. With this, the stage 6 connected to the nuts is lifted and lowered. In this case, the control device 71 causes the second lifting-lowering device 45 to lower the stage 6 so that the distance L1 between the recording medium W and the irradiating surface 40*t* of the ultraviolet irradiator 40B is made to be greater in a case that the ultraviolet irradiator 40B cures the clear ink than that in a case that the ultraviolet irradiator 40B cures the color ink. Also with such a configuration, it is possible to make the intensity of the ultraviolet light per unit area with respect to the clear ink to be small, thereby making it possible to suppress the generation of unevenness in the glossiness. Further, the control device 71 may control the second lifting-lowering device 45 so as to move the stage 6 in the up-down direction so that the irradiation range L3 of the ultraviolet light does not overlap with the projected area 10AP of the discharging head 10A on the recording medium W.

Figure 8:
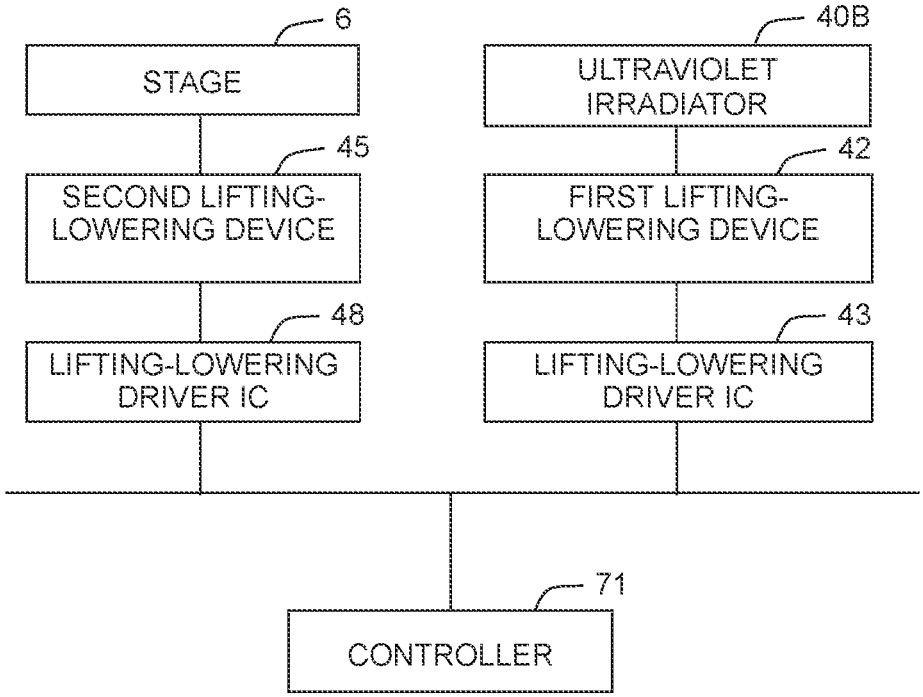
FIG. 8 is a block diagram of a control system in a case of providing both of a first lifting-lowering device and the second lifting-lowering device.

Furthermore, in the above-described embodiment, the distance L1 between the recording medium W and the irradiating surface 40*t* of the ultraviolet irradiator 40B is made to be great by lifting the ultraviolet irradiating device 40B by the first lifting-lowering device 42; in the above-described modification, the distance L1 between the recording medium W and the irradiating surface 40*t* of the ultraviolet irradiator 40B is made to be great by lowering the stage 6 by the second lifting-lowering device 45. The present disclosure, however, is not limited to this. As depicted in FIG. 8, it is allowable to provide both of the first lifting-lowering device 42 and the second lifting-lowering device 45, that the lifting-lowering driver IC 43 receives an instruction from the control device 71 to thereby cause the first lifting-lowering device 42 to lift the ultraviolet irradiator 40B and that the lifting-lowering driver IC 48 receives an instruction from the control device 71 to thereby cause the second lifting-lowering device 45 to lower the stage 6, thereby making the distance L1 between the recording medium W and the irradiating surface 40*t* of the ultraviolet irradiator 40B to be great. Alternatively, it is allowable to provide both of the first lifting-lowering device 42 and the second lifting-lowering device 45, and that only one of the first lifting-lowering device 42 and the second lifting-lowering device 45 to be activated, thereby making the distance L1 between the recording medium W and the irradiating surface 40*t* of the ultraviolet irradiator 40B to be great.

Figure 9A:
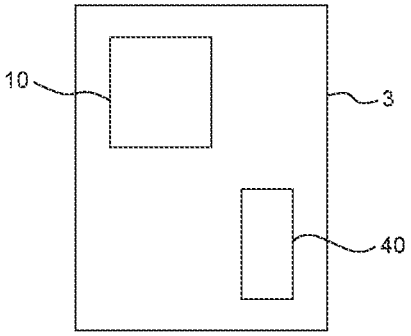
FIGS. 9A and 9B are views each of which depicts a modification of the discharging head and the ultraviolet irradiator.
Figure 9B:
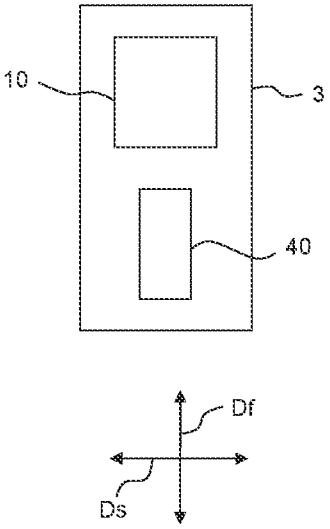

Moreover, in the above-described embodiment, the discharging head 10A and the discharging head 10B are provided as the discharging heads 10, and the ultraviolet irradiator 40A and the ultraviolet irradiator 40B are provided as the ultraviolet irradiators 40. The present disclosure, however, is not limited to this. For example, as depicted in FIG. 9A, it is allowable to mount, to the carriage 3, a discharging head 10 and an ultraviolet irradiator 40 which is arranged on the downstream side in the sub scanning direction Df (conveying direction) of the head 10 and arranged at a position different from the discharging head 10 in the main scanning direction Ds. Alternatively, as depicted in FIG. 9B, it is allowable to mount, to the carriage 3, a discharging head 10 and an ultraviolet irradiator 40 which is arranged on the downstream side in the sub scanning direction Df (conveying direction) of the head 10. Namely, in the aspect depicted in FIG. 9B, in the main scanning direction Ds, a range occupied by the ultraviolet irradiator 40 and a range occupied by the discharging head 10 overlap with each other.

Further, in the above-described embodiment, such a configuration is provided wherein the print job is received from the external computer 200 via the network interface 70, and the discharging processing is executed in a case that the instruction for turning ON the flag of the surface uniformizing printing is written in the header of the print job. The present disclosure, however, is not limited to this. It is also allowable to provide such a configuration wherein, for example, in a case that the user uses the operating key 4 or the displaying part 5 in the image recording apparatus 1 as described above so as to instruct the surface uniformizing printing, the flag of the surface uniformizing printing is turned ON to thereby execute the discharging processing.

What is claimed is:

1. A liquid discharging apparatus comprising:

a conveyor configured to convey a recording medium in a first direction;

a discharging head configured to discharge an ultraviolet light-curable clear ink to the recording medium;

an ultraviolet irradiator configured to irradiate, with ultraviolet light, the clear ink discharged to the recording medium, and arranged at a position different from the discharging head in the first direction;

a carriage configured to move in a second direction crossing the first direction, and having the discharging head and the ultraviolet irradiator mounted thereon; and a controller configured to control the conveyor to convey the recording medium from one side toward the other side in the first direction, wherein the controller is configured to control the ultraviolet irradiator to irradiate the recording medium with the ultraviolet light so that intensity of the ultraviolet light becomes weaker on the recording medium, from the one side toward the other side of the first direction.

2. The liquid discharging apparatus according to claim 1, wherein the controller is configured to control the discharging head, the ultraviolet irradiator, the carriage and the conveyor to:

discharge the clear ink from the discharging head to a predetermined print area on the recording medium while moving the carriage in the second direction;

after the discharge of the clear ink, convey the recording medium in the first direction to move the predetermined print area on the recording medium into an irradiation range of the ultraviolet light by the ultraviolet irradiator; and after the conveyance of the recording medium, irradiate the clear ink, which is discharged to the predetermined print area on the recording medium, with the ultraviolet light from the ultraviolet irradiator, while moving the carriage in the second direction.

3. The liquid discharging apparatus according to claim 2, wherein an orientation of movement along the second direction of the carriage in the discharge of the clear ink and an orientation of the movement along the second direction of the carriage in irradiation of the clear ink with the ultraviolet light are opposite to each other.

4. The liquid discharging apparatus according to claim 2, wherein an orientation of movement along the second direction of the carriage in the discharge of the clear ink and an orientation of the movement along the second direction of the carriage in irradiation of the clear ink with the ultraviolet light are same as each other.

5. The liquid discharging apparatus according to claim 4, wherein the controller is configured to control the carriage and the conveyor, in the conveyance of the recording medium in the first direction, to move the carriage in an orientation opposite to the orientation of the movement along the second direction of the carriage in the discharge of the clear ink.

6. The liquid discharging apparatus according to claim 2, wherein the ultraviolet irradiator is arranged on the other side in the first direction with respect to the discharging head.

7. The liquid discharging apparatus according to claim 2, further comprising a lifting-lowering device configured to move the ultraviolet irradiator in a third direction orthogonal to the first direction and the second direction;

wherein the discharging head is configured to further discharge an ultraviolet light-curable color ink to the recording medium;

the ultraviolet irradiator is configured to further irradiate, with the ultraviolet light, the color ink discharged to the recording medium; and the controller is configured to control the discharging head, the ultraviolet irradiator and the lifting-lowering device to:

discharge the color ink from the discharging head to the recording medium, irradiate the color ink, which is discharged to the recording medium, with the ultraviolet light from the ultraviolet irradiator, and move the ultraviolet irradiator in the third direction with the lifting-lowering device so that a distance in the third direction between the recording medium and an irradiating surface of the ultraviolet irradiator is made to be greater in irradiation of the clear ink with the ultraviolet light than that in irradiation of the color ink with the ultraviolet light.

8. The liquid discharging apparatus according to claim 7, wherein the controller is configured to control the lifting-lowering device to move the ultraviolet irradiator in the third direction so that an irradiation range, of the ultraviolet light by the ultraviolet irradiator, on the recording medium does not overlap with a projected area of the discharging head on the recording medium.

9. The liquid discharging apparatus according to claim 2, further comprising:

a stage configured to place the recording medium thereon; and a lifting-lowering device configured to move the stage in a third direction orthogonal to the first direction and the second direction, wherein the discharging head is configured to further discharge an ultraviolet light-curable color ink to the recording medium;

the ultraviolet irradiator is configured to further irradiate, with the ultraviolet light, the color ink discharged to the recording medium; and the controller is configured to control the discharging head, the ultraviolet irradiator and the lifting-lowering device to:

discharge the color ink from the discharging head to the recording medium, irradiate the color ink, which is discharged to the recording medium, with the ultraviolet light from the ultraviolet irradiator, and move the stage in the third direction with the lifting-lowering device so that a distance in the third direction between the recording medium and an irradiating surface of the ultraviolet irradiator is made to be greater in irradiation of the clear ink with the ultraviolet light than that in irradiation of the color ink with the ultraviolet light.

10. The liquid discharging apparatus according to claim 9, wherein the controller is configured to control the lifting-lowering device to move the stage in the third direction so that an irradiation range, of the ultraviolet light by the ultraviolet irradiator, on the recording medium does not overlap with a projected area of the discharging head on the recording medium.

11. The liquid discharging apparatus according to claim 2, wherein the controller is configured to control the discharging head, the ultraviolet irradiator, the carriage and the conveyor to:

perform the discharge of the clear ink, the conveyance of the recording medium and irradiation of the clear ink with the ultraviolet light in this order for a plurality of time; and perform irradiation of the clear ink with the ultraviolet light and the discharge of the clear ink, which is to be performed next thereto, at a same time.

12. The liquid discharging apparatus according to claim 1, wherein the ultraviolet irradiator is arranged to be apart in the first direction with respect to the discharging head.

13. The liquid discharging apparatus according to claim 1, wherein an irradiation range, of the ultraviolet light by the ultraviolet irradiator, on the recording medium does not overlap with a projected area of the discharging head on the recording medium.

14. The liquid discharging apparatus according to claim 1, wherein a range occupied by the ultraviolet irradiator and a range occupied by the discharging head do not overlap with each other in the first direction.

15. The liquid discharging apparatus according to claim 1, wherein a range occupied by the ultraviolet irradiator and a range occupied by the discharging head do not overlap with each other in the second direction.

16. The liquid discharging apparatus according to claim 1, wherein a range occupied by the ultraviolet irradiator in the second direction and a range occupied by the discharging head in the second direction overlap with each other.

* * * * *